US008166787B2

(12) United States Patent
Jung et al.

(10) Patent No.: US 8,166,787 B2
(45) Date of Patent: May 1, 2012

(54) SYSTEM FOR MANUFACTURING LINEAR GEAR AND THE METHOD THEREOF

(75) Inventors: Hee-won Jung, Hwasung-Si (KR); Young-June Park, Hwasung-Si (KR); Gil-Yong Yeom, Hwasung-Si (KR); Dong-Sam Kim, Hwasung-Si (KR); Jung-Su Lee, Hwasung-Si (KR)

(73) Assignee: Iljin Light Metal Co., Ltd. (KR)

( * ) Notice: Subject to any disclaimer, the term of this patent is extended or adjusted under 35 U.S.C. 154(b) by 726 days.

(21) Appl. No.: 12/302,310

(22) PCT Filed: Jun. 7, 2007

(86) PCT No.: PCT/KR2007/002752

§ 371 (c)(1),
(2), (4) Date: Nov. 25, 2008

(87) PCT Pub. No.: WO2007/142472

PCT Pub. Date: Dec. 13, 2007

(65) Prior Publication Data

US 2009/0158804 A1 Jun. 25, 2009

(30) Foreign Application Priority Data

Jun. 10, 2006 (KR) ..... 10-2006-0052273
Nov. 28, 2006 (KR) ..... 10-2006-0118070

(51) Int. Cl.
*B21D 39/02* (2006.01)

(52) U.S. Cl. ..... 72/210; 72/197; 72/214; 72/250; 72/342.1; 72/428

(58) Field of Classification Search ..... 72/192, 72/196–198, 200, 202, 342.1, 219, 148, 210, 72/240, 250, 361, 428
See application file for complete search history.

(56) References Cited

U.S. PATENT DOCUMENTS 3,646,794 A * 3/1972 Tishken ..... 72/187
3,756,057 A * 9/1973 Brooks et al. ..... 72/181
5,628,222 A * 5/1997 Yasuda et al. ..... 72/192
5,927,118 A * 7/1999 Minote et al. ..... 72/11.3

* cited by examiner

*Primary Examiner* — Edward Tolan
*Assistant Examiner* — Matthew G Katcoff
(74) *Attorney, Agent, or Firm* — Thomas, Kayden, Horstemeyer & Risley, LLP.

(57) ABSTRACT

The present invention relates to a system for and a method of manufacturing a linear gear (rack gear), in which a forming roll and a guide roll are used to form gear teeth in a sequential manner so as not to require a high load, thereby enabling to easily manufacture the rack gear. A system for manufacturing a rack gear according to the invention includes a forming roll having a convexo-concave portion formed on a part of the surface contacting with a linear bar, a guide roll adapted to roll while facing the forming roll, and at least one support member for supporting the linear bar so as to allow the linear bar to linearly move. A method of manufacturing a rack gear according to the invention includes a first step of passing a linear bar through between a pair of rollers provided in front of a forming roll and a guide roll, a second step of charging the linear bar into a charging hole between the forming roll and the guide roll, a third step of rolling the forming roll and the guide roll to partly form teeth on the outer circumferential surface of the linear bar, and a fourth step of rolling the forming roll and the guide roll forward or backward to discharge the linear bar.

18 Claims, 7 Drawing Sheets

[Fig. 1]
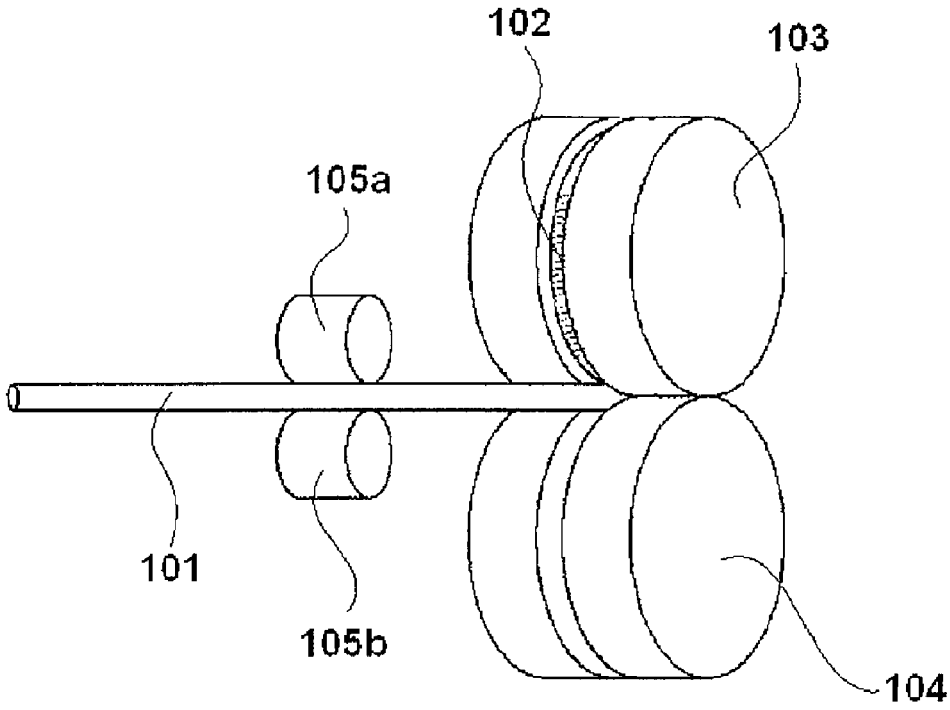
[Fig. 2]
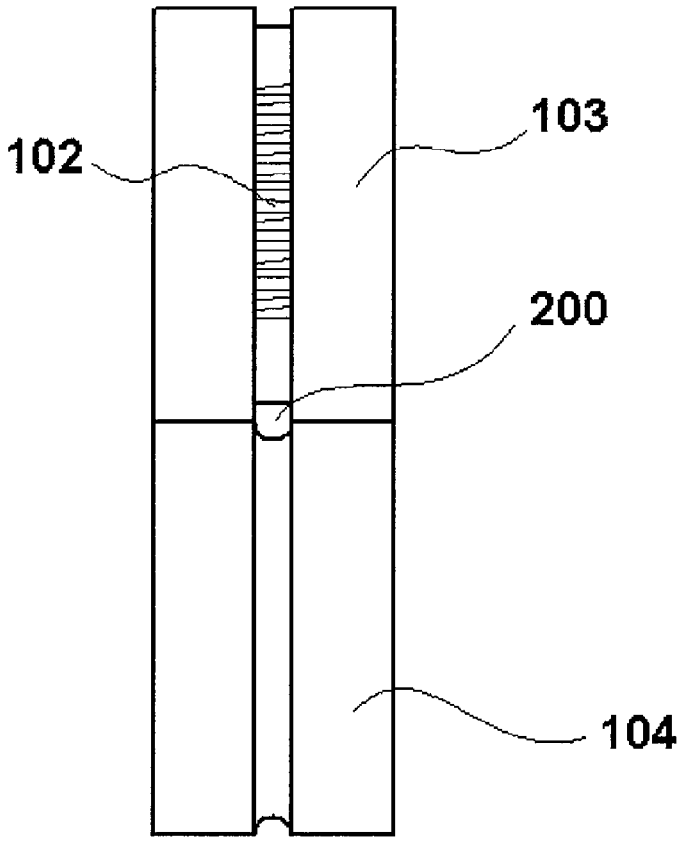

[Fig. 3]
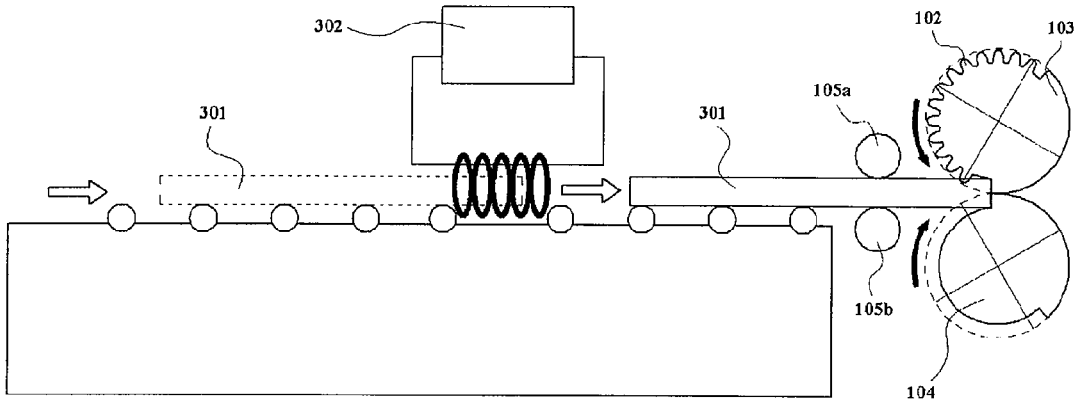
[Fig. 4]
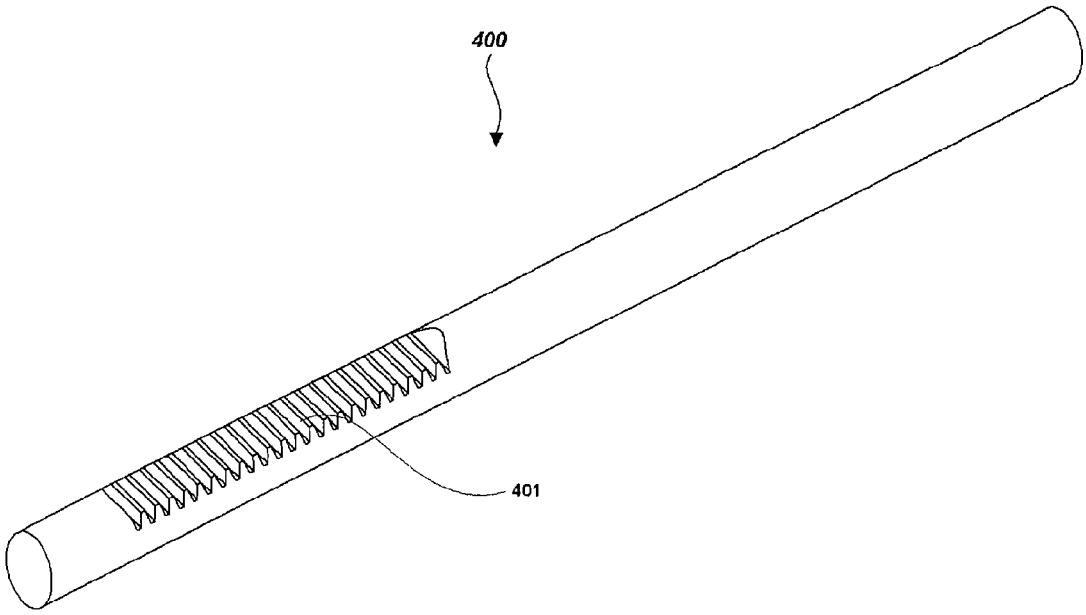

[Fig. 5]
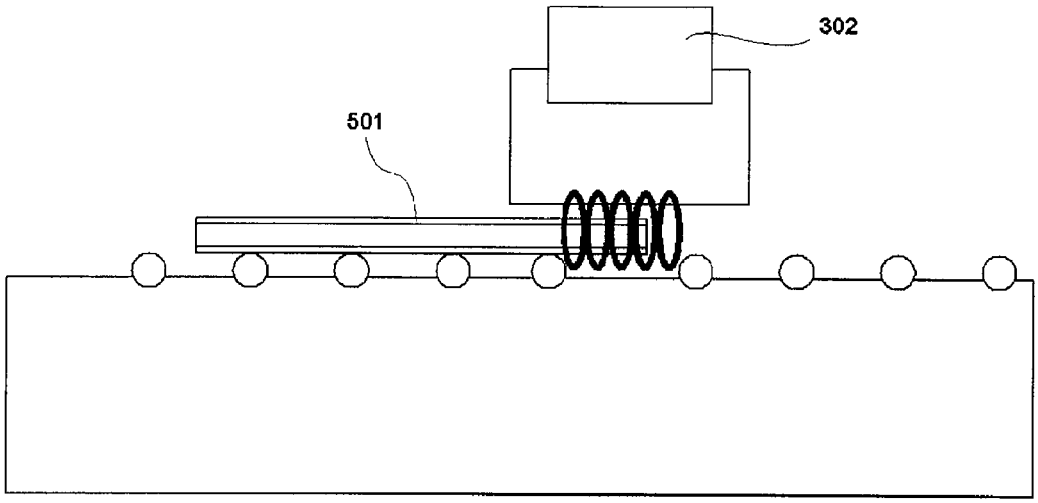
[Fig. 6]
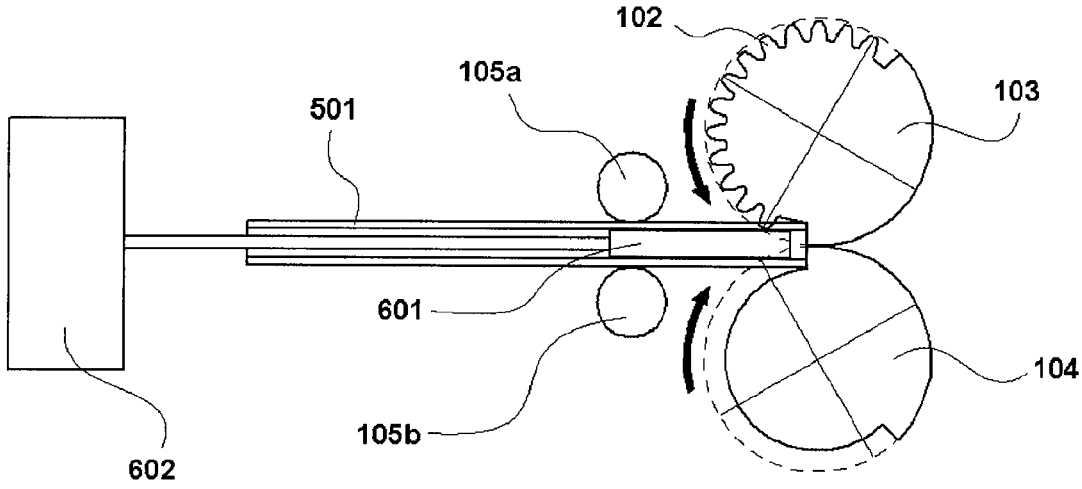

[Fig. 7]
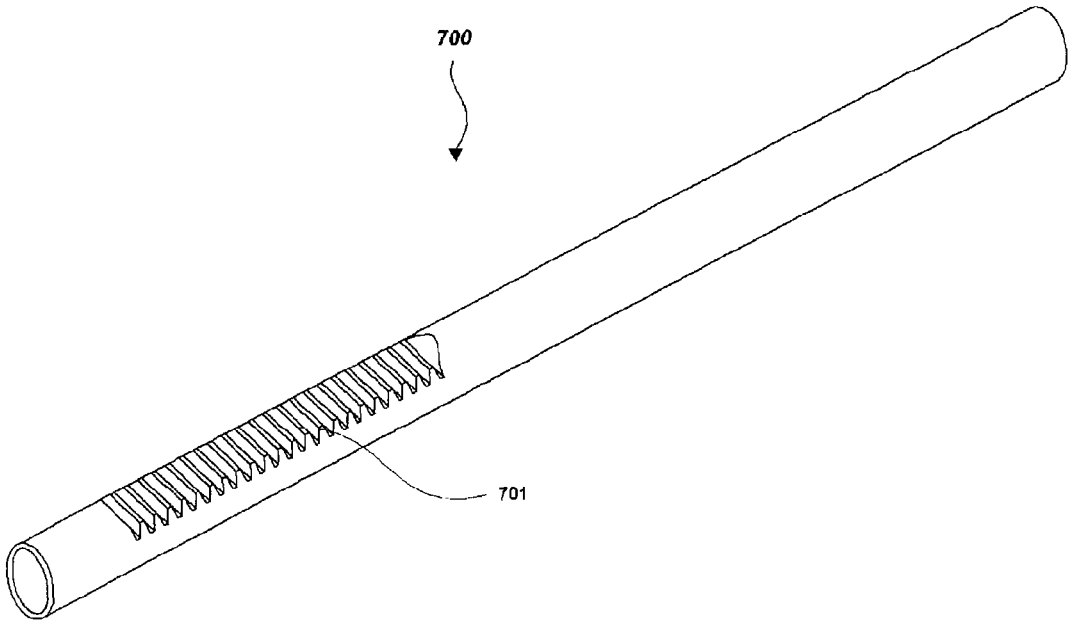
[Fig. 8]
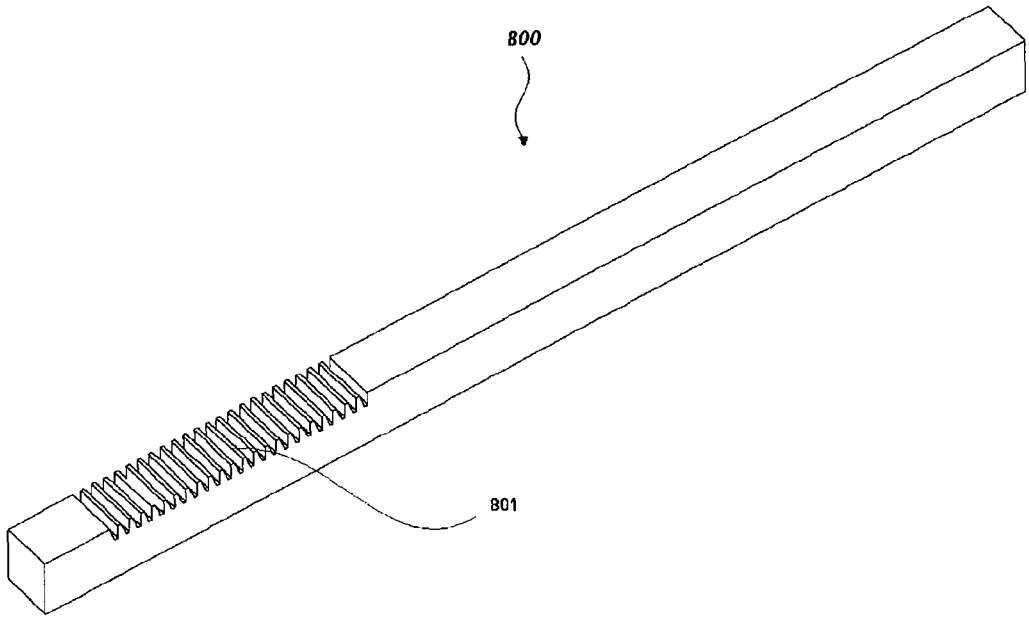

[Fig. 9]
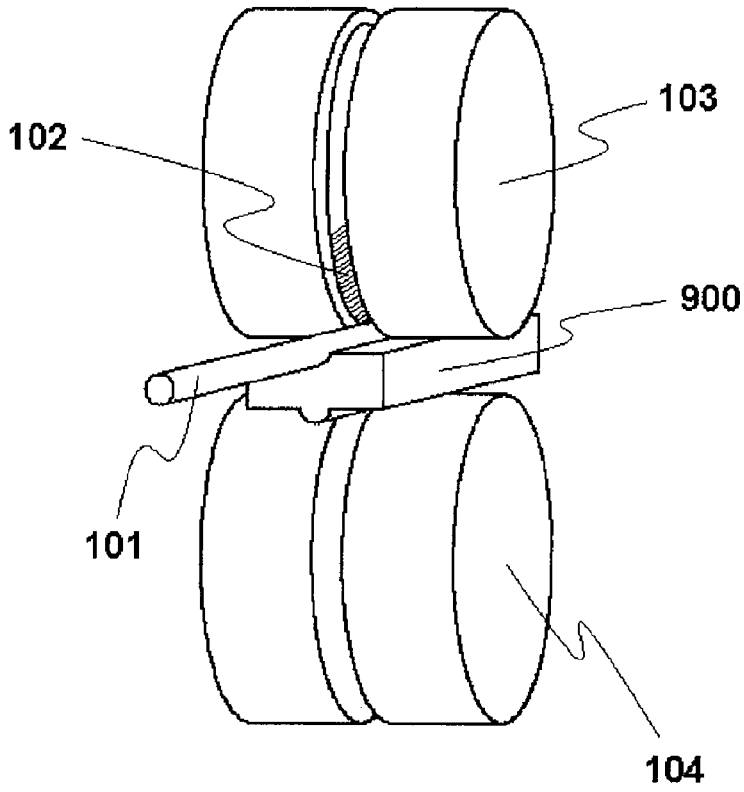
[Fig. 10]
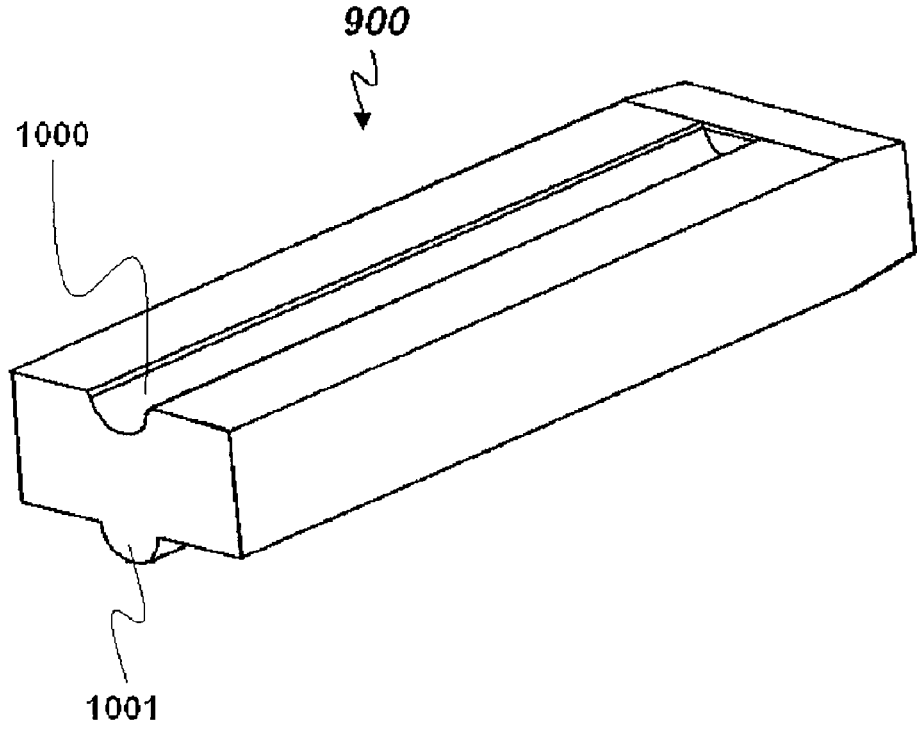

[Fig. 11]
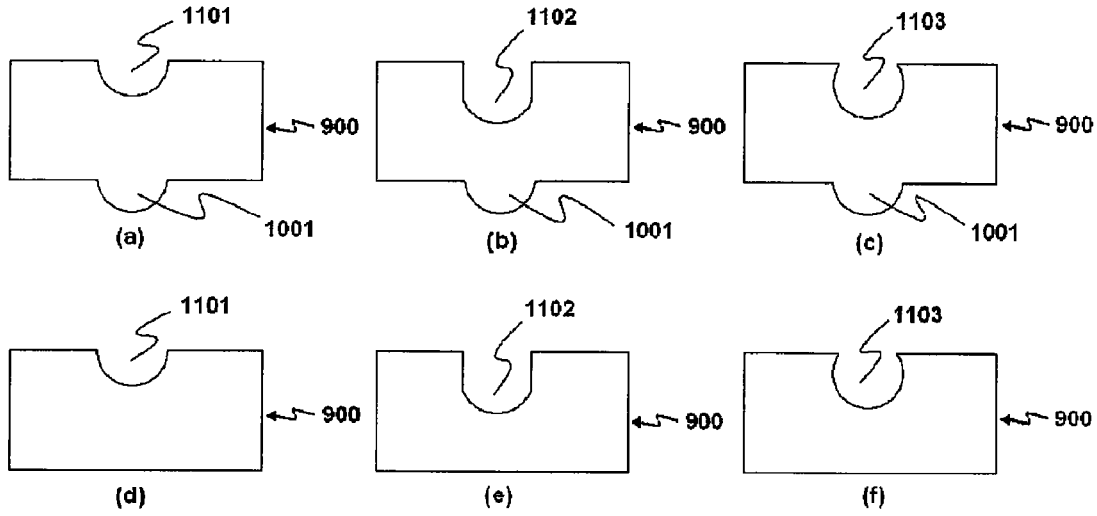
[Fig. 12]
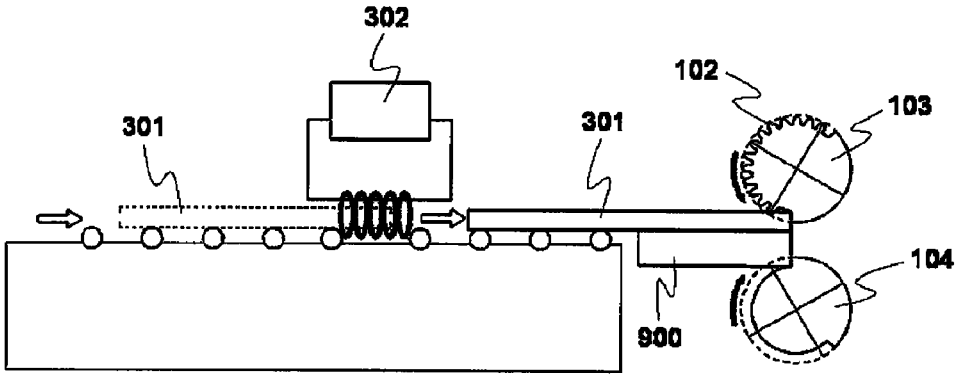
[Fig. 13]
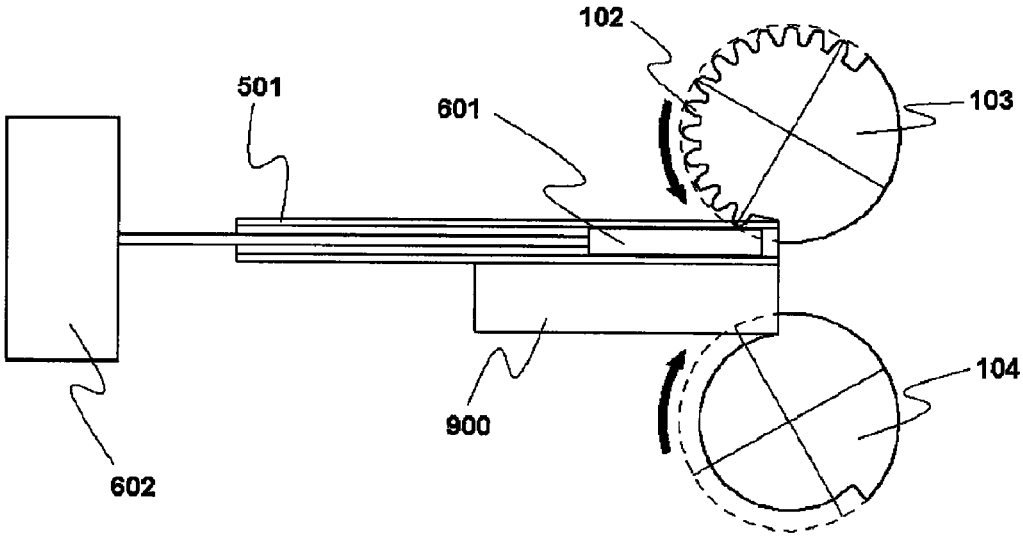

[Fig. 14]
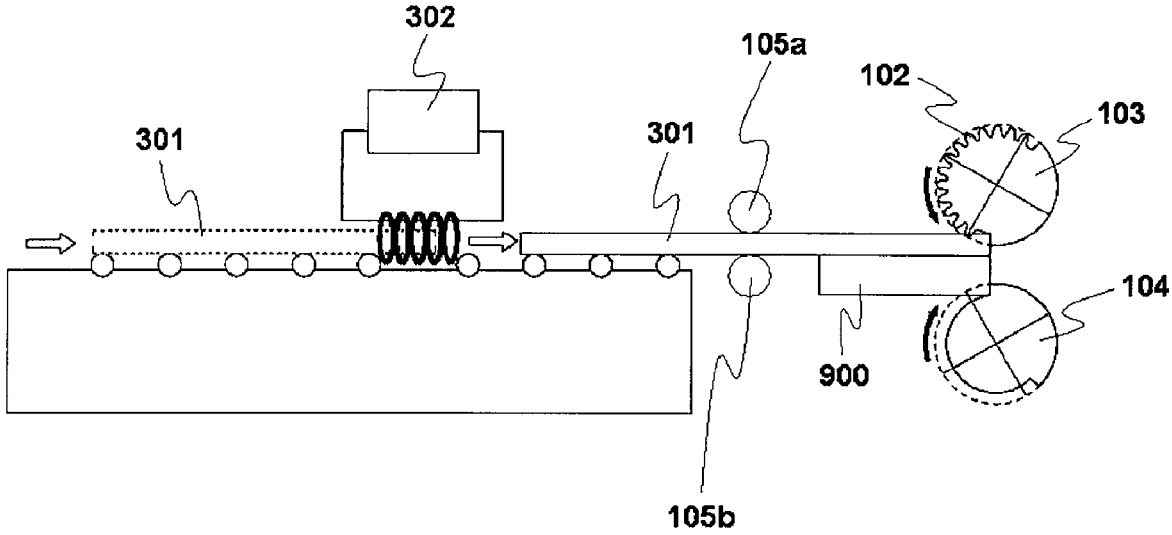

SYSTEM FOR MANUFACTURING LINEAR GEAR AND THE METHOD THEREOF

CROSS-REFERENCE TO RELATED APPLICATION

This application is a co-pending application which claims priority to PCT Application No. PCT/KR2007/002752, filed Jun. 7, 2007, herein incorporated by reference in its entirety.

TECHNICAL FIELD

The present invention relates to a system for and a method of manufacturing a linear gear (hereinafter rack gear) by plastic deformation of a linear bar using a forming roll with a convexo-concave portion and a guide roll supporting the linear bar.

BACKGROUND ART

In the conventional rack gear manufacturing techniques, one lateral side of a rack gear is machined in a regular pitch to form a teeth portion. However, these conventional methods embrace many problems due to high-cost and lower efficiency.

On the other hand, recently a liner gear of non-regular pitch has been used and a variable gear ratio (VGR) has been applied. In machining a rack gear having a non-regular pitch, a technology with high precision is required, and a high cost and extended process time are disadvantageously demanded as well.

In recent years, therefore, a forging method has been used to form the teeth of a rack gear in order to mitigate the demerits in the machining technique. The forming method has an advantage that a desired type of teeth can be formed in a relatively short time by plastic deformation of one lateral side of a linear bar. In addition, the mechanical properties of the rack gear can be improved.

For example, Japanese Patent Laid-Open Publication No. 2004136369 and U.S. Pat. No. 6,289,710 disclose a press forging for forming the teeth of a rack gear.

In the above mentioned press-forging technique, however, extremely small portion of a linear bar can be formed with teeth. Furthermore, the technique has drawbacks that distortion occurs quite often during plastic deformation and brittleness of the rack gear increases by instantaneously applying a high load deformation to the linear bar.

DISCLOSURE OF INVENTION

Technical Problem

Accordingly, the present invention has been made in an effort to solve the problems occurring in the prior art. It is an object of the invention to provide a system for and a method of manufacturing a rack gear, in which a forming roll and a guide roll are used to form gear-teeth in a sequential manner so as not to require a high load, thereby enabling to manufacture the rack gear in an easier manner.

Another object of the invention is to provide a system for and a method of manufacturing a rack gear, in which a forming roll with a convexo-concave portion is used in order to manufacture a rack gear of higher precision.

A further object of the invention is to provide a system for and a method of manufacturing a rack gear, in which the length of a convexo-concave portion can be adjusted so as to manufacture a rack gear with a desired length of teeth.

Technical Solution

To achieve the above object, according to an aspect of the invention, there is provided a system for manufacturing a rack gear. The system comprises: a forming roll having a convexo-concave portion formed on a part of the surface contacting with a linear bar; a guide roll adapted to roll while facing the forming roll; and at least one support member for supporting the linear bar so as to allow the linear bar to linearly move.

According to an aspect of the invention, there is provided a method of manufacturing a rack gear. The method comprises: a first step of passing a linear bar through between a pair of rollers provided in front of a forming roll and a guide roll; a second step of charging the linear bar into a charging hole between the forming roll and the guide roll; a third step of forming teeth on a part of the outer circumferential surface of the linear bar by rolling the forming roll and the guide roll on the linear bar; and a fourth step of discharging the linear bar by rolling the forming roll and the guide roll forward or backward.

According to another aspect of the invention, there is provided a method of manufacturing a rack gear. The method comprises: a first step of combining an auxiliary bar to a part of an outer circumferential surface of a linear bar; a second step of charging a part of the linear bar, combined with the auxiliary bar, between the forming roll with a convexo-concave portion and the guide roll; a third step of forming teeth on a part of the outer circumferential surface of the linear bar by rolling the forming roll and the guide roll on the linear bar; and a fourth step of discharging the linear bar and the auxiliary bar by rolling the forming roll and the guide roll forward or backward.

According to a further aspect of the invention, there is provided a method of manufacturing a rack gear. The method comprises: a first step of passing a linear bar through between a pair of rollers and combining an auxiliary bar to a part of the outer circumferential surface of the linear bar; a second step of charging a part of the linear bar, combined with the auxiliary bar, between the forming roll with a convexo-concave portion and the guide roll; a third step of forming teeth on a part of the outer circumferential surface of the linear bar by rolling the forming roll and the guide roll on the linear bar; and a fourth step of discharging the linear bar and the auxiliary bar by rolling the forming roll and the guide roll forward or backward.

Advantageous Effects

According to the present invention, a rack gear can be manufactured without limitation in the length of a teeth portion and the shape of the teeth.

In addition, extension of the service life of a rack gear can be achieved by applying weak impact and lower load to the linear bar when manufactured.

Furthermore, a rack gear of higher precision can be manufactured, thereby minimizing material loss and time required for manufacturing the rack gear.

BRIEF DESCRIPTION OF THE DRAWINGS

FIG. 1 is a perspective view showing a system for manufacturing a rack gear according to one embodiment of the invention;

FIG. 2 is a front view showing a forming roll and a guide roll according to one embodiment of the invention;

FIG. 3 is a sectional view showing a system for manufacturing a rack gear using a round bar, according to one embodiment of the invention;

FIG. 4 is a perspective view of a rack gear manufactured using a round bar, according to one embodiment of the invention;

FIG. 5 is a sectional view showing a system for manufacturing a rack gear using a pipe, according to one embodiment of the invention;

FIG. 6 is another sectional view showing a system for manufacturing a rack gear using a pipe, according to one embodiment of the invention;

FIG. 7 is a perspective view showing a rack gear manufactured using a pipe, according to one embodiment of the invention;

FIG. 8 is a perspective view showing a rack gear manufactured using a square bar, according to one embodiment of the invention;

FIG. 9 is a perspective view showing a system for manufacturing a rack gear according to another embodiment of the invention;

FIG. 10 is a perspective view showing an auxiliary bar according to another embodiment of the invention;

FIG. 11 is a sectional view showing an auxiliary bar according to another embodiment of the invention;

FIG. 12 is a sectional view showing a system for manufacturing a rack gear using a round bar, according to another embodiment of the invention;

FIG. 13 is a sectional view showing a system for manufacturing a rack gear using a pipe, according to another embodiment of the invention; and FIG. 14 is a sectional view showing a system for manufacturing a rack gear using a round bar, according to another embodiment of the invention.

DESCRIPTION ON REFERENCE NUMERALS

101: Linear bar
102: Convexo-concave portion
103: Forming roll
104: Guide roll
105*a*, 105*b*: Roller
302: Induction heater
900: Auxiliary bar

MODE FOR THE INVENTION

Hereinafter, preferred embodiments of the present invention will be explained in detail with reference to the accompanying drawings. Before explaining the invention, the terms and words used in the description and claims is not to be limited to ordinary meanings or dictionary definitions. Under the principles that the inventors are entitled to act as his or her own lexicographer in order to explain his or her own invention in the best way, those terms and words are to be construed so as to conform to the technical concept of the present invention.

The constructions disclosed in the specification and drawings show one preferred embodiment of the invention, not represent all the technical concepts of the invention. It is therefore understood that at the time of filing this application, various alternatives and modifications to these constructions may occur to those skilled in the art.

FIG. 1 is a perspective view showing a system for manufacturing a rack gear according to one embodiment of the invention. Referring to FIG. 1, the system includes a forming roll 103, with a convexo-concave portion 102 in a part of the surface contacting with the linear bar 101, for forming teeth on a part of the surface of a linear bar 101, a guide roll 104 rolling while facing the forming roll 103, and support members consisted of a pair of rollers 105*a* and 105*b*, which are positioned in front of the forming and guide rolls 103 and 104, for preventing the linear bar 101 from bending by plastic deformation or wobbling.

Herein, according to an embodiment of the invention, the size and shape of the forming roll 103 and the guide roll 104 are determined according to the size and shape of the linear bar 101. In the forming roll 102, the length and shape of the convexo-concave portion 102 are determined according to the length and shape of teeth to be formed in the linear bar 101.

In addition, according to an embodiment of the invention, the linear bar 101 may be a solid bar or a hollow bar.

Furthermore, according to an embodiment of the invention, the shape of the cross-section of the linear bar 101 may be polygonal, circular, or oval.

Further, according to an embodiment of the invention, the teeth to be formed on a part of the surface of the linear bar 101 satisfy a variable gear ratio.

In addition, the rack gear manufacturing system according to an embodiment of the invention may include a heating means for heating the linear bar 101 in order to improve workability, instead of forming at normal temperature.

FIG. 2 is a front view showing a forming roll 103 and a guide roll 104 according to one embodiment of the invention. As shown in FIG. 2, the forming roll 103 and the guide roll 104 according to an embodiment of the invention faces each other so that a charging hole 200 can be formed into which the linear bar 101 can be charged. After a linear bar 101 is charged into the charging hole 200, the forming roll 103 and the guide roll 104 are rolled to form teeth on a part of the outer circumferential surface of the linear bar 101.

FIG. 3 is a sectional view showing a system for and a method of manufacturing a rack gear using a round bar, according to one embodiment of the invention. Referring to FIG. 3, in order to easily form teeth in a round bar, a part of the round bar 301 is heated using an induction heater 302 to improve workability. At this time, the heating temperature is maintained between 500° C. and 1200° C. The reason therefor is that, if the heating temperature is lower than 500° C., the workability is not improved enough to form desired teeth, and if the heating temperature exceeds 1200° C., the round bar 301 is decarburized and unnecessary heating leads to reduce productivity by wasting energy.

In order to partly form teeth on the outer circumferential surface of the round bar 301, the round bar 301 passes through support members consisted of a pair of rollers 105*a* and 105*b* and positioned in front of the forming roll 103 and the guide roll 104. Then, at least a part of the heated round bar 301 is charged into the charging hole 200, which is formed by contacting with each other of the forming roll 103 with a convexo-concave portion 102 and the guide roll 104 supporting the round bar 301. At this time, the support members protect the round bar 301 from bending by plastic deformation or wobbling.

When the round bar 301 is made firm by the forming roll 103, the guide roll 104 and the support members, the forming roll 103 and the guide roll 104 are rolled towards the round bar to form teeth on a part of the outer circumferential surface of the round bar 301. Here, formation of the teeth is performed by the convexo-concave portion 102 formed in the forming roll 103.

When desired teeth are formed on the round bar 301, the forming roll 103 and the guide roll 104 are rolled forward or backward to discharge the round bar 301. In this way, a rack gear 400 is formed from the round bar 301. The configuration of the formed rack gear is shown in FIG. 4. Referring to FIG. 4, a teeth portion 401 is formed in the round bar 301 to manufacture a rack gear 400.

FIGS. 5 and 6 are sectional views showing a system for and a method of manufacturing a rack gear using a pipe, according to one embodiment of the invention. As shown in FIG. 5, in order to easily form teeth on a part of the outer circumferential surface of a pipe 501, the part of the pipe 501 is heated up to between 500° C. and 1200° C. using an induction heater 302 to thereby improve workability.

As shown in FIG. 6, an internal support member 601 is inserted into the hollow of the heated pipe 501, thereby preventing distortion of the pipe 501 when being plastic deformed. At this time, the internal support member 601 is inserted into the pipe by exerting a pressure using a press 602. The press 602 exerts the pressure until the internal support member 601 reaches a position corresponding to the part of the pipe 501 where teeth is to be formed.

In order to form teeth in the pipe 501 into which the internal support member 601 is inserted, the pipe 501 is made firm by support members consisted of a pair of rollers 105*a* and 105*b* which are placed in front of the forming roll 103 and the guide roll 104. The heated pipe 501 is charged into a charging hole 200, which is formed by contacting with each other of the forming roll 103 and the guide roll 104. At this time, the support members protect the pipe 501 from bending by plastic deformation or wobbling.

When the pipe 501 is made firm by the forming roll 103, the guide roll 104 and the support members, the forming roll 103 and the guide roll 104 are rolled towards the pipe 501 to form teeth on a part of the outercircumferential surface of the pipe 501. Here, formation of teeth is performed by the convexo-concave portion 102 formed in the forming roll 103.

When desired teeth are formed on the pipe 501, the forming roll 103 and the guide roll 104 are rolled forward or backward to discharge the pipe 501. In this way, a rack gear 700 is formed from the pipe 501. The configuration of the formed rack gear is shown in FIG. 7. Referring to FIG. 7, a teeth portion 701 is formed in the pipe 501 to manufacture a rack gear 700.

As one embodiment of the invention, a bar with a square cross-section can be formed into a rack gear. When manufacturing a rack gear using a square bar, a charging hole 200 formed between the forming roll 103 and the guide roll 104 has a square shape with an enough size to satisfy the charging of the quadrangular bar.

FIG. 8 shows a rack gear 800 manufactured using a bar with a square cross-section, in which a teeth portion 801 is formed in a part of one lateral side of the square bar.

FIG. 9 is a perspective view showing a system for manufacturing a rack gear according to another embodiment of the invention. Referring to FIG. 9, the rack gear manufacturing system according to this embodiment includes a forming roll 103 with a convexo-concave portion 102 in a part of the surface contacting with a linear bar 101, a guide roll 104 rolling while facing the forming roll 103, and an auxiliary bar 900 to be combined with a part of the outer circumferential surface of the linear bar 101 for preventing the linear bar 101 from bending or wobbling when being formed with teeth. Here, the auxiliary bar 900 according to this embodiment serves as a support member.

In addition, the auxiliary bar 900 of this embodiment linearly moves integrally with the linear bar 101, and passes through the space between the forming roll 103 and the guide roll 104.

FIG. 10 is a perspective view showing an auxiliary bar according to another embodiment of the invention. FIG. 11 is a sectional view showing various types of auxiliary bars according to another embodiment of the invention. Referring to FIGS. 10 and 11, the auxiliary bar 900 according to another embodiment of the invention can have a support groove 1000 formed in one lateral side thereof so as to be easily combined with the linear bar 101, and optionally a protrusion 1001 formed in the other lateral side, which is engaged with a groove formed in the guide roll 104 to thereby strengthen the support of the linear bar 101 when rolling.

According to another embodiment of the invention, when the support groove 1000 of the auxiliary bar 900 is engaged with part of the outer circumferential surface of the linear bar 101, it is preferable that the support groove 1000 of the auxiliary bar 900 encircles 30% to 80% of the outercircumferential surface of the linear bar 101. At this time, if the embracing range is above 30%, the straightness and roundness of the rack gear are further improved. If the embracing range is less than 80%, teeth formation on a part of the outer circumferential surface of the linear bar 101 is further facilitated.

In addition, the auxiliary bar 900 may have various types of cross-sections according to another embodiment of the invention. For example, the auxiliary bar 900 may include an auxiliary bar having a support groove 1101 with a semicircular cross-section (FIG. 11(*a*)), an auxiliary bar having a support groove 1102 with a U-shaped cross-section for holding the linear bar 101 in a more stable manner (FIG. 11(*b*)), an auxiliary bar having a support groove 1103 with a C-shaped cross-section for fixedly inserting and holding the linear bar (FIG. 11(*c*)), etc. Further, according to other embodiments of the invention, the auxiliary bar 900 may not include the protrusion 1001 as long as the linear bar 101 is not bent when forming teeth in the linear bar 101, for example, as shown in FIGS. 11(*d*), 11(*e*) and 11(*f*) of which support grooves are corresponding to FIGS. 11(*a*), 11(*b*) and 11(*c*).

FIG. 12 is a sectional view showing a system for and a method of manufacturing a rack gear using a round bar according to another embodiment of the invention. As shown in FIG. 12, for the purpose of easy formation of teeth in the round bar 301, a part of the round bar 301 is heated using an induction heater 302 to enhance plastic deformability. At this time, the heating temperature is maintained in a range of 500° C. to 1200° C.

In order to form teeth in a round bar 301, the auxiliary bar 900 is combined to a part of the outercircumferential surface of the round bar 301. Then, the round bar 301 with the auxiliary bar is inserted between the forming roll 103 with a convexo-concave portion 102 and the guide roll 104 rolling facing the forming roll. At this time, the other lateral side of the round bar 301, which is not contacted with the auxiliary bar, is to contact the convexo-concave portion 102 and the auxiliary bar 900 is to contact the guide roll 104. Here, the auxiliary bar serves as a support member and protects the round bar 301 from bending by plastic deformation and wobbling.

When the round bar 301 combined with the auxiliary bar 900 is positioned between the forming roll 103 and the guide roll 104, the forming roll 103 and the guide roll 104 are rolled towards the round bar 301 to form teeth on a part of the outer circumferential surface of the round bar 301. At this time, the teeth formation is performed by the convexo-concave portion 102 formed in the forming roll 103.

When desired teeth are formed on the round bar 301, the forming roll 103 and the guide roll 104 are rolled forward or backward to discharge the round bar 301 with which the auxiliary bar 900 is combined. In this way, a rack gear is manufactured from the round bar 301.

FIG. 13 is a sectional view showing a system for and a method of manufacturing a liner gear using a pipe, according to another embodiment of the invention.

As shown in FIG. 5, for easy formation of teeth in a pipe 501, a part of the pipe 501 is heated up to between 500° C. and 1200° C. using an induction heater 302, thereby improving plastic deformability.

As shown in FIG. 13, an internal support member 601 is inserted inside the hollow of the partially heated pipe 501. Then, an auxiliary bar 900 is combined with a part of the outercircumferential surface of the pipe 501 and thereafter charged between the forming roll 103 with a convexo-concave portion 102 and the guide roll 104 supporting the pipe 501. Here, the other lateral side of the pipe 501, which is not contacted with the auxiliary bar, is to contact the convexo-concave portion 102 and the auxiliary bar 900 is to contact the guide roll 104.

When the pipe 501 combined with the auxiliary bar 900 is positioned between the forming roll 103 and the guide roll 104, the forming roll 103 and the guide roll 104 are rolled towards the pipe 501 to form teeth on a part of the outer circumferential surface of the pipe 501.

When desired teeth are formed on the pipe 501, the forming roll 103 and the guide roll 104 are rolled forward or backward to discharge the pipe 501 with which the auxiliary bar 900 is combined. In this way, a rack gear is manufactured from the pipe 501.

According to another embodiment of the invention, a bar with a square cross-section can be formed into a rack gear. In case where a square bar is formed into a rack gear, the groove formed in the forming roll 103 and the support groove 1001 formed in the auxiliary bar 900 serving as a support member 105 have a square shape so as to cross-sectionally conform to the square bar.

FIG. 14 is a sectional view showing a system for and a method of manufacturing a rack gear using a round bar, according to another embodiment of the invention. As shown in FIG. 14, according to yet another embodiment of the invention, a pair of rollers 105*a* and 105*b* formed in front of the forming roll 103 and the guide roll 104 and the auxiliary bar 900 combined to a part of the outer circumferential surface of the linear bar 101 are used together as support members, thereby enabling to protect the linear bar 101 from bending by plastic deformation or wobbling when forming teeth on the linear bar 101.

Further, according to yet another embodiment of the invention, the system for manufacturing a rack gear, in which a pair of rollers 105*a* and 105*b* and an auxiliary bar 900 are used as support members, can be applied to a pipe, a square bar, or the like.

According to the embodiments of the invention, a rolling method, not a forging technique, is used to manufacture a rack gear, thereby enabling to obtain a rack gear with a desired length of a teeth portion.

In addition, according to the embodiments of the invention, a rack gear having different gear ratios or a non-rack gear can be manufactured.

While the present invention has been described with reference to several preferred embodiments, the description is illustrative of the invention and is not to be construed as limiting the invention. Various modifications and variations may occur to those skilled in the art without departing from the spirit and scope of the invention as defined by the appended claims.

The invention claimed is:

1. A system for manufacturing a rack gear from a linear bar, the system comprising:

a forming roll having a convexo-concave portion formed on a part of the surface contacting with a linear bar;

a guide roll adapted to roll while facing the forming roll; and an auxiliary bar linearly moving integrally with the linear bar, the auxiliary bar having a support groove formed in one lateral side so as to be combined with a part of the outer circumferential surface of the linear bar, the auxiliary bar having a longitudinal protrusion portion formed in the other lateral side so as to contact with a circumferential groove of the guide roll.

2. The system according to claim 1, further comprising a heating means for heating the linear bar.

3. The system according to claim 2, wherein the heating means is an induction heater.

4. The system according to claim 3, wherein the heating temperature of the heating means is in a range of 500° C. to 1200° C.

5. The system according to claim 1, further comprising at least one pair of rollers provided in front of the forming roll and the guide roll.

6. The system according to claim 1, wherein the auxiliary bar passes through between the forming roll and the guide roll, along with the linear bar.

7. The system according to claim 1, wherein the support groove encircles 30% to 80% of the outer circumferential surface of the linear bar when being combined with the linear bar.

8. A method of manufacturing a rack gear, the method comprising:

a first step of combining an auxiliary bar to a part of an outer circumferential surface of a linear bar, the auxiliary bar having a support groove for receiving the linear bar when combined;

a second step of charging a part of the linear bar, combined with the auxiliary bar, between the forming roll with a convexo-concave portion and the guide roll;

a third step of forming teeth on a part of the outer circumferential surface of the linear bar by rolling the forming roll and the guide roll on the linear bar; and a fourth step of discharging the linear bar and the auxiliary bar by rolling the forming roll and the guide roll forward or backward.

9. The method according to claim 8, before the first step, further comprising a step of heating the linear bar using an induction heater.

10. The method according to claim 8, wherein:

the linear bar is hollow; and the method further comprises, between the first step and the second step, a step of inserting an internal support member into the hollow of the linear bar.

11. A method of manufacturing a rack gear, the method comprising:

a first step of passing a linear bar through between a pair of rollers and combining an auxiliary bar to a part of the outer circumferential surface of the linear bar, the auxiliary bar having a support groove for receiving the linear bar when combined;

a second step of charging a part of the linear bar, combined with the auxiliary bar, between the forming roll with a convexo-concave portion and the guide roll;

a third step of forming teeth on a part of the outer circumferential surface of the linear bar by rolling the forming roll and the guide roll on the linear bar; and a fourth step of discharging the linear bar and the auxiliary bar by rolling the forming roll and the guide roll forward or backward.

12. The method according to claim 11, before the first step, further comprising a step of heating the linear bar using an induction heater.

13. The method according to claim 11, wherein:

the linear bar is hollow; and the method further comprises, between the first step and the second step, a step of inserting an internal support member into the hollow of the linear bar.

14. The system according to claim 1, wherein:

the linear bar is hollow; and the system further comprises a movable internal support member operative to be inserted into the hollow of the linear bar such that the support member supports the linear bar during passage through the forming roll.

15. The method according to claim 8, wherein the auxiliary bar has a longitudinal protrusion portion formed in the other lateral side so as to contact with a circumferential groove of the guide roll.

16. The method according to claim 8, wherein the support groove encircles 30% to 80% of the outer circumferential surface of the linear bar when being combined with the linear bar.

17. The method according to claim 11, wherein the auxiliary bar has a longitudinal protrusion portion formed in the other lateral side so as to contact with a circumferential groove of the guide roll.

18. The method according to claim 11, wherein the support groove encircles 30% to 80% of the outer circumferential surface of the linear bar when being combined with the linear bar.

* * * * *